US008122692B2

(12) United States Patent
Inoue et al.

(10) Patent No.: US 8,122,692 B2
(45) Date of Patent: Feb. 28, 2012

(54) EMPTY BAG SUPPLY METHOD AND EMPTY BAG SUPPLY APPARATUS

(75) Inventors: Yoshiteru Inoue, Iwakuni (JP); Akio Yamane, Iwakuni (JP); Yoshikatsu Nakahara, Iwakuni (JP)

(73) Assignee: Toyo Jidoki Co., Ltd., Tokyo (JP)

( * ) Notice: Subject to any disclaimer, the term of this patent is extended or adjusted under 35 U.S.C. 154(b) by 251 days.

(21) Appl. No.: 12/462,152

(22) Filed: Jul. 30, 2009

(65) Prior Publication Data

US 2010/0024362 A1 Feb. 4, 2010

(30) Foreign Application Priority Data

Jul. 31, 2008 (JP) ..... 2008-198866

(51) Int. Cl.
*B65B 43/42* (2006.01)

(52) U.S. Cl. ..... 53/492; 53/386.1

(58) Field of Classification Search ..... 53/492, 53/468, 467, 381.1, 381.6, 384.1, 386.1
See application file for complete search history.

(56) References Cited

U.S. PATENT DOCUMENTS

| | | | | |
|---|---|---|---|---|
| 2,950,589 | A * | 8/1960 | Litchard | 53/573 |
| 3,380,222 | A * | 4/1968 | Bergmann et al. | 53/449 |
| 3,501,893 | A * | 3/1970 | Peterson | 53/573 |
| 4,078,358 | A * | 3/1978 | Henderson | 53/459 |
| 4,345,629 | A * | 8/1982 | Inglett, Jr. | 141/114 |
| 4,612,965 | A * | 9/1986 | McGregor | 141/114 |
| 4,729,209 | A * | 3/1988 | Owensby et al. | 53/434 |
| 5,095,686 | A * | 3/1992 | Marshall et al. | 53/571 |
| 5,201,166 | A * | 4/1993 | Johnsen | 53/571 |
| 5,417,039 | A * | 5/1995 | Hansson et al. | 53/449 |
| 5,771,667 | A * | 6/1998 | McGregor et al. | 53/469 |
| 6,347,499 | B1 * | 2/2002 | McGregor et al. | 53/374.9 |
| 6,964,146 | B2 * | 11/2005 | LaRocca | 53/459 |
| 7,363,753 | B2 * | 4/2008 | Gates et al. | 53/459 |

FOREIGN PATENT DOCUMENTS

| | | |
|---|---|---|
| DE | 38 40 646 | 6/1990 |
| DE | 41 43 342 | 1/1993 |
| EP | 1 520 788 | 4/2005 |
| JP | H7-5125 | 1/1995 |
| JP | 2603966 U | 4/2000 |
| JP | 2003-137219 | 5/2003 |
| JP | 2006-123910 | 5/2006 |
| JP | 2006-143264 | 6/2006 |

* cited by examiner

*Primary Examiner* — Paul Durand
(74) *Attorney, Agent, or Firm* — DLA Piper LLP (US)

(57) ABSTRACT

An empty bag supply method and apparatus first lifting up with a first suction member an empty bag of which bag bottom being in contact with and positioned by a first positioning stopper. The lifted bag is then held by chucks and transported upwards so that the empty bag is vertical with the bag bottom facing upward, and then a second suction member suctions the empty bag near the bag mouth and transports it onto a conveyor with the bag mouth facing forward, so that the bag mouth of the bag is stopped and positioned by a second positioning stopper. The empty bag is then lifted up by a third suction member, held by a chuck and transported upward so that the attitude of the bag is changed to vertical with the bag mouth facing upward, and then the bag is transferred to a gripper of a packaging apparatus.

8 Claims, 6 Drawing Sheets

EMPTY BAG SUPPLY METHOD AND EMPTY BAG SUPPLY APPARATUS

BACKGROUND OF THE INVENTION

1. Field of the Invention

The present invention relates to improvements in an empty bag supply method and empty bag supply apparatus in which an uppermost bag of a group of bags stacked in a conveyor magazine is sequentially taken out and transported along a predetermined bag transportation path, so that the bag is finally transferred to, for instance, a gripper of a bag packaging apparatus.

2. Description of the Related Art

Japanese Utility Model Registration No. 2603966 discloses a conveyor magazine; and in this conveyer magazine, a belt conveyor conveys a group of empty bags stacked in such a format that the bag mouths are facing forward and the upper bags shifted forward, and a fast-feed belt separates the uppermost empty bag from the group of empty bags on the belt conveyor and feeds it out forward. A toothed wheel is provided on the belt conveyor at the forward side of the fast-feed belt so that it feeds out forward the empty bag separated by the fast-feed belt, and further a positioning stopper is provided so that the tip end of the bag mouth of the empty bag fed by the toothed wheel comes into contact with it and the bag is thus positioned by this positioning stopper by the bag mouth. The empty bag positioned by the stopper in the conveyor magazine is changed from a roughly horizontal attitude to a substantially vertical attitude with the bag mouth facing upward and then supplied to a neighboring bag packaging apparatus.

In this type of a conveyor magazine-style bag supply apparatus, when supplying zipper-equipped bags or spout-equipped bags, problems would occur. More specifically, when an empty bag that is equipped with additional elements (for instance, a zipper, a spout or the like) that has certain thickness near the bag mouth is supplied, though an empty bag below the uppermost empty bag (next lower empty bags) is fast-fed by the fast-feed belt, the next empty bag may be impeded from being fed forward beyond the toothed wheel. This is because when the toothed wheel descends and contacts the uppermost empty bag, pressure is applied to the next lower empty bag through the uppermost empty bag, and as a result, the zipper, spout or other part of the next lower empty bag is caught on the toothed wheel, so that the forward movement of the bag is impeded. When this occurs, the next lower empty bag bends upward; and though the bag eventually returns to its original flat state when the toothed wheel ascends and the toothed wheel pressure is released, the bending and returning phenomenon can create irregular fetches and inappropriate positioning of the uppermost empty bag.

In the conveyor magazines disclosed in Japanese Patent Application Laid-Open (Kokai) Nos. 2006-123910 and 2006-143264, a bag is transported with its bottom facing in the bag feeding direction, so that the tip end of the bag bottom comes into contact with a stopper and the empty bag is thus positioned by the stopper (positioning by the bag bottom). Though this would resolve the above-described problem that would occur when positioning is made by the bag mouth as seen in Japanese Utility Model Registration No. 2603966 (in which next lower empty bags bend and return, creating inappropriate fetch or inappropriate positioning of the uppermost empty bag), it creates new problems as noted below even when the bag bottom faces in the bag feeding direction, since ultimately the empty bag must be supplied to the gripper of a bag packaging apparatus with the bag mouth facing upward.

(1) Because the empty bag is positioned by the bag bottom, whenever the bag surface of the empty bag is distorted in a wave shape in the direction of the length, the position of the bag mouth of the empty bag will not be consistent. As a result, in Japanese Patent Application Laid-Open (Kokai) No. 2006-123910, the suction position of a vacuum cup 17 tends to shift in the direction of the length of the empty bag, and in Japanese Patent Application Laid-Open (Kokai) No. 2006-143264, the gripping position of the gripping claw 41 will shift in the direction of the length of the empty bag; as a result, the empty bag's height (height position of bag mouth) when the empty bag is transferred to the bag packaging apparatus gripper will not be adequate. This creates a problem that the gripping position of the gripper becomes different in the direction of length for each empty bag.

(2) When empty bags supplied to the bag packaging apparatus are changed to those which are of different length dimensions, stopper adjustment is not required when positioning of the bag is made by the bag mouth as in Japanese Utility Model Registration No. 2603966; however, in Japanese Patent Application Laid-Open (Kokai) No. 2006-123910, the location of the stopper (12) needs to be changed; and in Japanese Patent Application Laid-Open (Kokai) No. 2006-143264, the location of the stopper (32) needs to be changed. Since the adjustment precision of the stoppers directly affects the precision of where the empty bag is supplied to grippers, adjustment work must be made extremely carefully, and thus it creates a major burden on the operator.

BRIEF SUMMARY OF THE INVENTION

The present invention is to solve the problems described above that occur when a group of empty bags is stacked within a conveyor magazine, transferred in a bag feeding direction with bag bottom facing forward, and the uppermost empty bag in the stacked group of empty bags is taken out sequentially from the conveyor magazine, so that the empty bag is transported along a predetermined bag transportation path and then transferred to a gripper of a bag packaging apparatus.

It is, therefore, an object of the present invention to provide an empty bag supply method and apparatus wherein the height of an empty bag when the bag is transferred to a gripper of a bag packaging apparatus is constantly kept at adequate height so that the position where the gripper grips the bag mouth of the empty bag is kept unchanged.

It is another object of the present invention to provide an empty bag supply method and apparatus that facilitates stopper adjustment work when working on empty bags of different length dimensions.

The above objects are accomplished by unique steps of the present invention for an empty bag supply method that

- separates and feeds out an empty bag that is uppermost of a group of empty bags stacked on a conveyor in such a format that bag bottoms of the empty bags face forward and upper bags are shifted forward,
- feeds the empty bag forward so that the empty bag comes into contact with a first positioning stopper thus being positioned by a bag bottom thereof, then
- transports the empty bag along a predetermined bag transportation path, and then
- transfers the empty bag to a gripper of a bag packaging apparatus; and in the present invention, the empty bag supply method is characterized in that the method comprises the steps of:

changing the attitude of the empty bag being positioned by the bag bottom, so that the empty bag is brought substantially vertical with the bag bottom facing upward, transporting the empty bag with its bag mouth facing forward and bringing the bag mouth into contact with a second positioning stopper, thus positioning the empty bag by the bag mouth, changing the attitude of the empty bag being positioned by the bag mouth, so that the empty bag takes a substantially vertical attitude with the bag mouth facing upward, and transferring the empty bag to the gripper of the bag packaging apparatus.

More specifically, in the present invention, a first suction member suctions the top surface of the empty bag being positioned at a bag bottom thereof, the first suction member lifts up the empty bag to a first transfer position, a first transporting member holds the empty bag moved to the first transfer position, the first transporting member transports the empty bag to a second transfer position and changes the attitude of the empty bag so that the empty bag takes a substantially vertical attitude with the bag bottom facing upward, a second suction member suctions the front surface of the empty bag which is substantially in a vertical attitude, the second suction member transports the empty bag, with a bag mouth thereof facing forward, to a third transfer position which is on a positioning conveyor or on a positioning chute, the bag mouth of the empty bag is brought into contact with a second positioning stopper on the positioning conveyor or on the positioning chute so that the empty bag is positioned by the bag mouth, a third suction member suctions the top surface of the empty bag being positioned by the bag mouth, the third suction member lifts up the empty bag to a fourth transfer position, a second transporting member holds the empty bag moved to the fourth transfer position, the second transporting member transports the empty bag to a fifth transfer position and changes the attitude of the empty bag so that the empty bag takes a substantially vertical attitude with the bag mouth facing upward, and then the empty bag is transferred to the gripper of the bag packaging apparatus.

Furthermore, the above objects are accomplished by a unique structure of the present invention for an empty bag supply apparatus that includes a conveyor magazine provided with:

a belt conveyor for conveying a group of empty bags stacked in such a format that bag bottoms of the empty bags face forward and upper bags are shifted forward, a fast-feed belt for separating an uppermost empty bag from the group of empty bags on the belt conveyor and feeding out the empty bag forward, a toothed wheel provided on a forward side of the fast-feed belt on the belt conveyor so as to feed out the empty bag separated by the fast-feed belt forward, and a first positioning stopper with which a bottom end of the empty bag fed out by the toothed wheel comes into contact, so that the empty bag supply apparatus transports the empty bag positioned by contacting the first positioning stopper along a predetermined bag transportation path and transfers the empty bag to a gripper of a bag packaging apparatus; and in the present invention, it is characterized in that the empty bag supply apparatus further includes:

a first suction member that suctions the top surface of the empty bag being positioned by the first positioning stopper and lifts up the empty bag to a first transfer position, a first transporting member that receives from the first suction member the empty bag moved to the first transfer position and transports the empty bag to a second transfer position so that the empty bag takes a substantially vertical attitude with its bag bottom facing upward, a second suction member that suctions the front surface of the empty bag of substantially vertical attitude and transports the empty bag to a third transfer position with its bag mouth facing forward, a positioning conveyor or positioning chute that at the third transfer position receives the empty bag being suctioned by the second suction member and transports the empty bag forward, the positioning conveyor or positioning chute being provided with a second positioning stopper with which the tip end of the bag mouth of the empty bag comes into contact, a third suction member that suctions the top surface of the empty bag, which is in contact with the second positioning stopper and thereby being positioned, and lifts up the empty bag to a fourth transfer position, and a second transporting member that receives from the third suction member the empty bag moved to the fourth transfer position and transports the empty bag to a fifth transfer position so that the empty bag takes a substantially vertical attitude with the bag mouth facing upward; and at the fifth transfer position the empty bag supply apparatus transfers the empty bag to a gripper of a bag packaging apparatus.

The above-described empty bag supply apparatus of the present invention can take the following specific structures:

(1) The positioning conveyor or positioning chute is provided with a lifting member that raises the underside of the empty bag which is in contact by the bag mouth with the second positioning stopper, thus creating a space between the empty bag and the supporting surface of the positioning conveyor or positioning chute so that a next empty bag can enter the space. With this structure, a next empty bag can be fed in while the previous empty bag is still on the positioning conveyor or positioning chute, thus increasing the processing capability.

(2) The positioning conveyor or positioning chute can be provided with a lifting member that projects up from below through the conveyance surface so that the lifting member, when projected out above the conveyance surface, raises the underside of the empty bag which is in contact by the bag mouth with the second positioning stopper, thus creating a space between the empty bag and the conveyance surface so that a next empty bag can enter the space. With this structure, a next empty bag fed in can be stopped by the lifting member and is not fed all the way to the second positioning stopper. As a result, the third suction member is prevented from taking two bags together.

(3) The empty bag supply apparatus can be further provided with a suction assistance plate which is provided near the second transfer position and moves back and forth between a retreated position that avoids interference with an empty bag being transported to the second transfer position and a suction assistance position that faces the suction surface of the second suction member which suctions the front surface of the empty bag which is in a substantially vertical attitude at the second transfer position. This suction assistance plate supports the rear surface of the empty bag at the suction assistance position so as to assist the second suction member to suction the empty bag.

(4) The first transporting member can be comprised of a pair of gripping members that grip both side edges of the empty bag. This structure having two separated gripping members makes it easy to prevent interference with the first suction member.

(5) The first positioning stopper can be positionally variable in a direction of conveyance of the belt conveyor. This structure of variable positions in the first positioning stopper in the conveyance direction enables the empty bags with different dimensions of length to be supplied.

As seen from the above, according to the present invention, in a conveyor magazine, an empty bag is transported with its bottom facing forward, and the orientation of the empty bag being transported is reversed during the transportation (in other words, the bag being conveyed is changed from a bag bottom facing forward transportation to a bag mouth facing forward transportation), and then the empty bag is positioned with respect to (or by) the bag mouth by the second positioning stopper. Accordingly, even the surface of an empty bag becomes wavy, the height of the empty bag can always be kept adequately when the bag is transferred to the gripper of the bag packaging apparatus, and there is no variation from bag to bag regarding the potion at which the gripper grips the bag mouth. This means that empty bags are received assuredly by the gripper, and the height of the bag mouth gripped by the gripper does not vary from bag to bag; and thus, for example, the position or width of the seal part (adhering part) formed at the bag mouth after filling of content is done can be kept constant.

When change is made for empty bags supplied to the bag packaging apparatus that have different length dimensions, the location of the conveyor magazine's first positioning stopper is adjusted (by way of moving it in the direction of conveyance) as necessary in the supply apparatus of the present invention as well; however, in the present invention, positioning for the empty bag that has been fed out of the conveyor magazine is made one more time and this positioning is made with respect to (or by) the bag mouth. Accordingly, the above-described position adjustment for the first positioning stopper does not need to be highly precise, allowing the bag positioning adjustment work to be done easily in a short period of time. The location of the second positioning stopper, which positions the empty bag with respect to (or by) the bag mouth, does not need to be adjusted even when the length of the empty bags is changed.

Further, the conveyor magazine of the present invention conveys empty bags with bag bottoms facing forward. Accordingly, it is free of problems of the type (inappropriate fetches and/or inappropriate positioning of empty bags, for instance) that would occur in conveyor magazines in which bags are fed out with the bag mouth facing forward.

DETAILED DESCRIPTION OF THE INVENTION

The present invention will be described in more detail below with reference to FIGS. 1 through 6.

Figure 1:
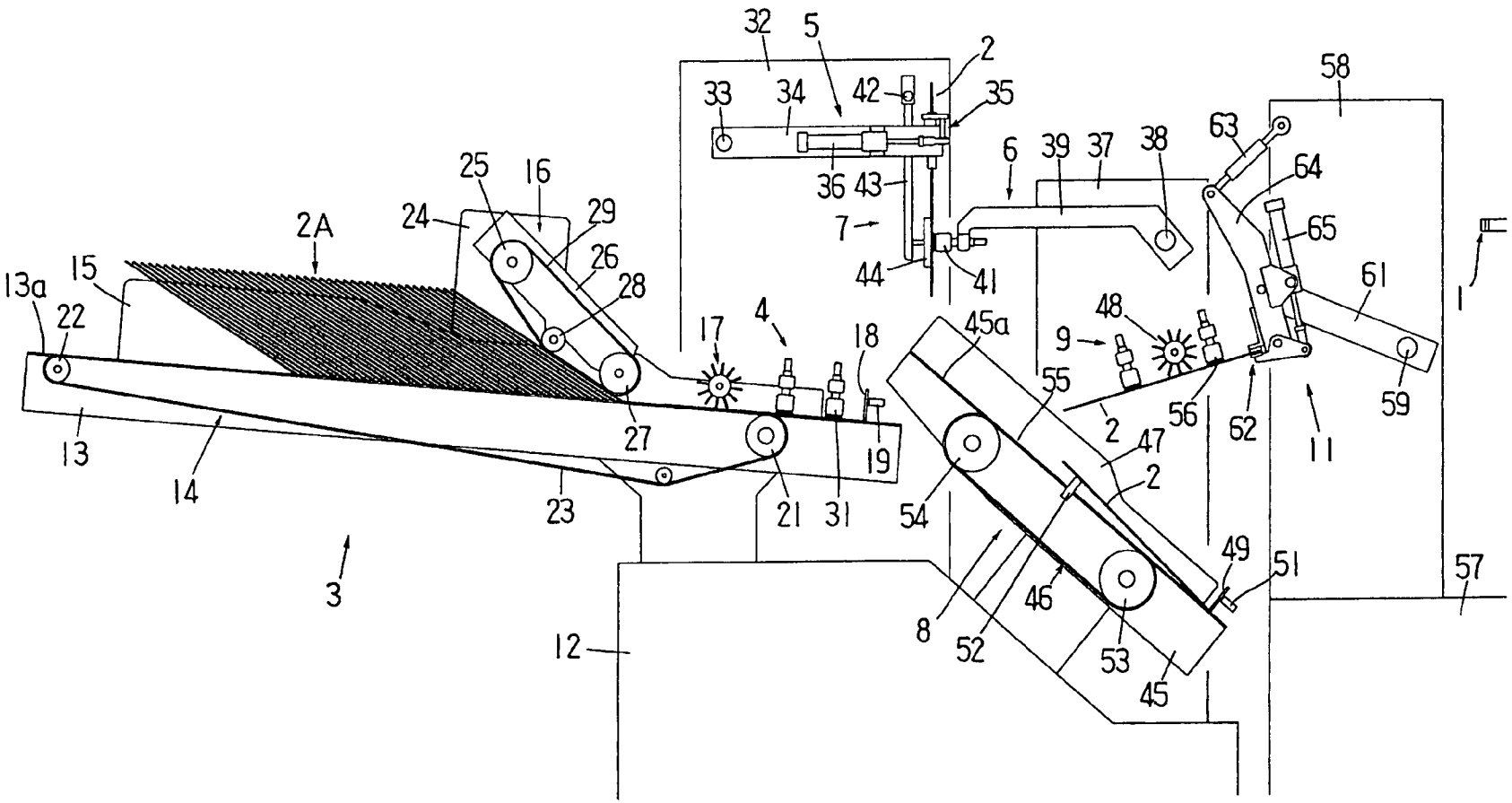
FIG. 1 is a side view of the empty bag supply apparatus according to the present invention.
Figure 2:
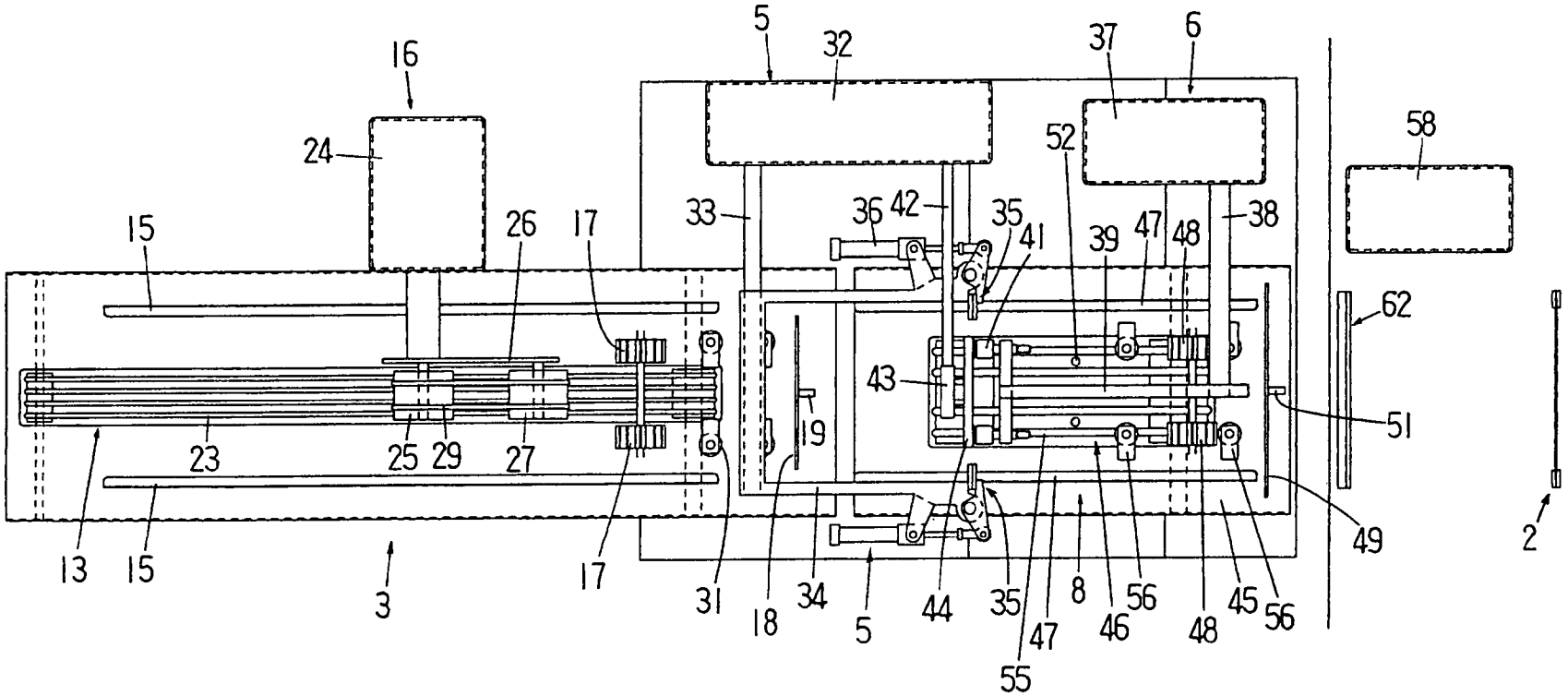
FIG. 2 is a top view thereof.

FIGS. 1 and 2 show the entirety of the empty bag supply apparatus and show the flow of the steps of the empty bag supply method of the present invention, and FIGS. 3 through 6 are the partially enlarged views of FIGS. 1 and 2. This empty bag supply apparatus can be installed next to, for example, a known intermittently rotating table type bag packaging apparatus (that includes grippers around a table, and only the gripper 1 is shown in the drawings), and it supplies an empty bag 2 to the gripper 1 so that the gripper 1 receives the bag in a substantially vertical attitude with the bag mouth facing upward. The empty bag supply apparatus comprises a conveyor magazine 3, a first suction device 4, a first transport device 5, a second suction device 6, a suction assistance device 7, a positioning device 8, a third suction device 9 and a second transport device 11.

The conveyor magazine 3 itself is of a known technology (see Japanese Utility Model Registration No. 2603966, etc.), and it is equipped with a frame 13 installed on the base 12, a belt conveyor 14 installed in the center of the frame 13, guide plates 15 installed on the left and right sides of the belt conveyor 14 on the top surface 13*a* of the frame 13, and a fast-feed device 16 disposed above the belt conveyor 14. The conveyor magazine 3 is further equipped with a feed-out device (only the toothed wheels 17 are shown) disposed above the belt conveyor 14 and in the forward position (or on the downstream side in the bag transporting direction, from left to right in FIG. 1) of the fast-feed device 16, a first positioning stopper 18 which is for positioning an empty bag and installed to project up on the top surface 13*a* of the frame 13, and a first sensor 19 that detects whether an empty bag on the belt conveyor 14 has come into contact with the first positioning stopper 18.

More specifically, the belt conveyor 14 is comprised of pulleys 21 and 22 rotatably disposed on the frame 13 and four belts 23 provided around the pulleys 21 and 22. The pulley 21 is linked to a drive source (not shown) and rotated, thus rotatably drive the belts 23.

The fast-feed device 16 is comprised of a drive box 24 installed on the frame 13 and houses inside a drive mechanism that includes a drive source, a rotating pulley 25 connected to the drive mechanism of the drive box 24, a free arm 26 mounted on the drive box 24 in coaxial with the pulley 25 and able to swing freely, pulleys 27 and 28 mounted on the free arm 26, and a fast-feed belt 29 wound around the pulleys 25, 27 and 28. A sensor (not shown) that detects the angle of the swing motion of the free arm 26 (which swings up when an empty bag 2 passes under the pulley 27) is provided on the fast-feed device 16, so that the pulley 21 of the belt conveyor 14 rotates continuously (and thus the belt 23 rotates) when the swing angle of the free arm 26 is no more than a predetermined value, and the rotation of the pulley 21 is stopped when the swing angle of the free arm 26 has exceeds the predetermined value. The rotation of the pulley 25 of the fast-feed device 16 is controlled by the detection signal from the first sensor 19, so that when a bag-not-detected signal is emitted from the first sensor 19 (that means no empty bag in contact with the first positioning stopper 18 detected) for a predetermined length of time, the pulley 25 starts rotating (and thus the fast-feed belt 29 is rotated) and continues the rotation until a bag-detected signal is emitted by the first sensor 19. The rotation of the fast-feed belt 29 of the fast-feed device 16 is faster than the conveyance speed of the belt conveyor 14.

The toothed wheels 17, the main part of the feed-out device, are provided so as to be able to move up and down (in the shown embodiment, it swings up and down) and have multiple pliable projections (teeth) around the peripheries (see Japanese Patent Application Laid-Open (Kokai) No. 2003-137219). When bag-not-detected signal from the first sensor 19 has continued a predetermined length of time, the toothed wheels 17 descend and rotate and keep rotating until the first sensor 19 sends out a bag-detected signal (upon an empty bag has come into contact with the first positioning stopper 18). The rotation of the outside peripheries of the toothed wheels 17 is faster than the rotation of the belt conveyor 14.

Figure 3:
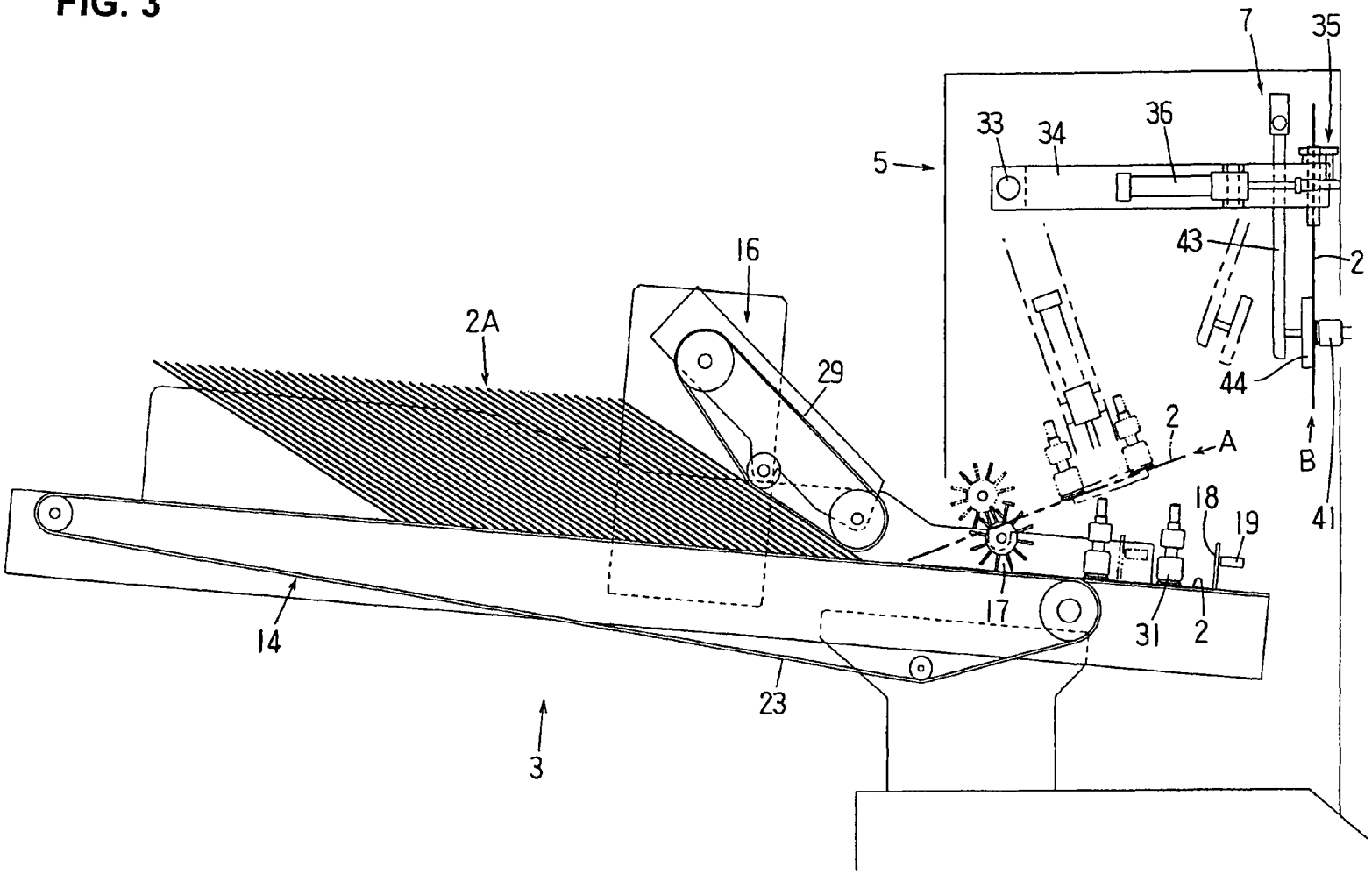
FIG. 3 is an enlarged side view primarily showing the left half of FIG. 1.
Figure 4:
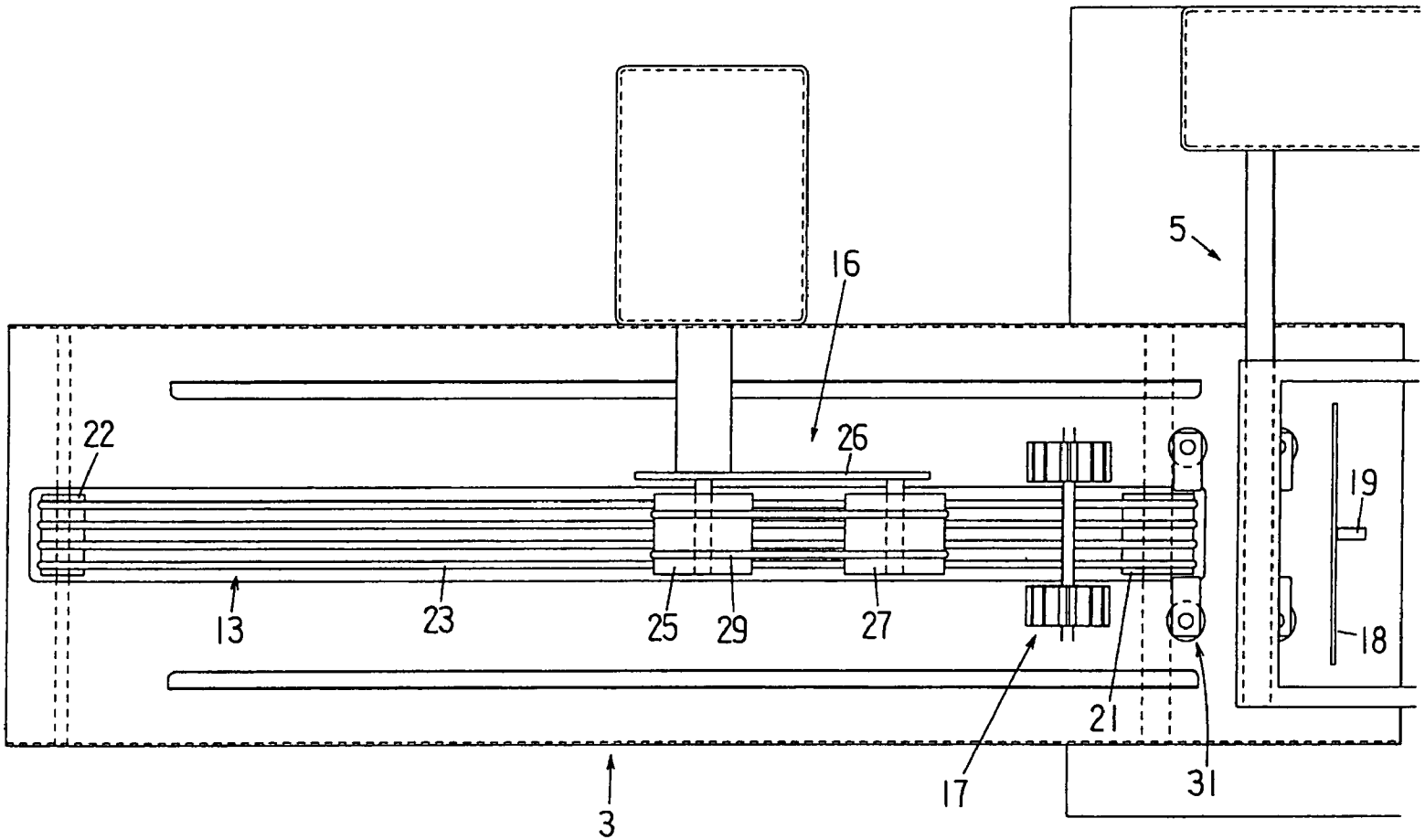
FIG. 4 is an enlarged top view primarily showing the left half of FIG. 2.

The location of the first positioning stopper 18 is adjustable in the conveyance direction of the belt conveyor 14 (In FIG. 3, the first positioning stopper 18 after the location adjustment is done is shown by the dotted line).

The group of empty bags 2A is, as best seen from FIG. 1, placed on the belt conveyor 14 of the conveyor magazine 3 so that they are stacked with bag bottoms facing forward and upper bags being shifted forward. The empty bags are conveyed and fed out forward one by one. When an uppermost empty bag 2 of the group of empty bags 2A comes into contact with fast-feed belt 29, it is separated from the group of the empty bags 2A and fast-fed forward, fast-fed forward again by the toothed wheels 17, and then stopped and positioned when it comes into contact with the first positioning stopper 18. The part of the empty bag 2 that touches the first positioning stopper 18 at this time is the bag bottom end, and thus the positioning by the first positioning stopper 18 is made with respect to the bag bottom ("bag bottom positioning").

For the first suction device 4 of the shown embodiment of the bag supply apparatus and method of the present invention, only four first suction members 31 thereof are shown (see FIGS. 1 and 2). These first suction members 31 are connected to switching valves and vacuum sources by vacuum piping (not shown), and they can ascend and descend (in the shown embodiment, they ascend and descend by swinging). The first suction members 31 thus suction the upper surface of the empty bag 2 after the bag is brought into contact with and thus positioned by the first positioning stopper 18, and then the first suction members 31 lift up the empty bag 2 to, as shown in FIG. 3, a first transfer position A (the position where the bag is transferred from first suction members 31 to a first transporting member (chucks 35) to be described below) shown by the dotted line. When the first sensor 19 sends out the bag-detected signal, the first suction members 31 start vacuum suction, descend simultaneously, suction the spots near the bag bottom on the upper surface of the positioned empty bag 2 and then ascend to lift up mainly at the bottom of the empty bag 2 from the conveyance surface (top surface 13*a*) of the conveyor magazine 3. When the first suction members 31 ascend, the toothed wheels 17 also ascend simultaneously (see Japanese Patent Application Laid-Open (Kokai) No. 2003-137219).

The first transport device 5 of the shown embodiment is provided above the first suction device 4 and is equipped with a drive box 32 which is installed on the base 12 and houses therein an internal drive mechanism. The first transport device 5 further includes a rotary shaft 33 connected to the drive box 32 so as to rotate within a predetermined range, a pair of swing arms 34 affixed to the rotary shaft 33 so as to swing within a predetermined range, a pair of chucks 35 (called a "first transporting member" in the present invention) respectively installed at the tip end of each one of the swing arms 34, and an air cylinder 36 installed in each swing arm 34 that opens and closes the chuck 35.

As seen from FIG. 3, the swing arms 34 swing between the position shown by the solid line and the position shown by the dotted line; and as they swing, the chucks 35 receive the empty bag 2, which is being suctioned by first suction members 31 and arriving at first transfer position A, from the first suction members 31, transport it to a higher second transfer position B (the position where the bag is transferred from the first transporting member (chucks 35) to second suction members 41 (described below)), and then change the attitude of the bag to substantially vertical with the bag bottom facing upward. The transfer of the empty bag 2 from the first suction members 31 to the chucks 35 is completed after the chucks 35 hold the two side edges of the empty bag 2 near the bag bottom once the bag has arrived at the first transfer position A and the vacuum suction of the first suction members 31 is stopped.

The second suction device 6 of the shown embodiment is provided in a forward position (or on the downstream side in the bag transporting direction) of the first transport device 5 and is equipped with a drive box 37 installed on the base 12 and housing therein an internal drive mechanism. The second suction device 6 is, as best seen from FIG. 6, further equipped with a rotary shaft 38 connected to the drive box 37 so as to rotate within a predetermined range, a swing arm 39 that is affixed to the rotary shaft 38 and swings within a predetermined range, and two second suction members 41 installed at the tip end of the swing arm 39. The swing arm 39 swings between the positions shown by the solid and dotted lines in FIG. 5; and as it swings, the second suction members 41 receive the empty bag 2, which is being held by the chucks 35 in a substantially vertical attitude at the transfer position B, from the chucks 35 and transport it to a lower third transfer position C (where the bag is transferred from the second suction members 41 to the positioning device 8 (described below)). Transfer of the empty bag 2 from the chucks 35 to the second suction members 41 is completed after the second suction members 41 suction the front surface near the bag mouth of the empty bag 2 that has arrived at the second transfer position B, and the air cylinders 36 are activated to open the chucks 35.

The second suction device 6 is for reversing the direction of the empty bag 2 being transported (from a bag bottom facing forward conveyance to a bag mouth facing forward conveyance). Thus, the empty bag 2 suctioned by the second suction members 41 is transported toward the third transfer position C with the bag mouth facing forward.

The suction assistance device 7 of the shown embodiment is provided behind the second suction device 6 (or on the upstream side in the bag transferring direction) near the second transfer position B; and it, in addition to the above-described drive box 32 housing therein an internal drive mechanism, is comprised of a rotary shaft 42 connected to the drive box 32 so as to rotate within a predetermined range, a swing arm 43 affixed to the rotary shaft 42 so as to swing within a predetermined range, and a suction assistance plate 44 installed at the tip end of the swing arm 43. As seen from FIG. 5, the swing arm 43 swings between the positions shown by the solid and dotted lines; and as it swings, the suction assistance plate 44 attached to the swing arm 43 is moved back and forth between the retreated position shown by the dotted line and the suction assistance position shown by the solid line. At the retreated position, interference between the suction assistance plate 44 and the empty bag 2 that is being transported to the second transfer position B is prevented. At the suction assistance position, the suction assistance plate 44 opposes the suction surfaces of the second suction members 41, which suction the front surface of empty bag 2 that is substantially vertical at the second transfer position B, and supports the rear side of the empty bag 2. The suction assistance plate 44 pushes the empty bag 2 toward the second suction members 41.

Should static electricity or the like causes multiple empty bags to stick together in the conveyor magazine 3 and two or more empty bags 2 be fed out of by the first suction members 31 ("multiple bag transfer"), the two or more empty bags 2 will be transported to the second transfer position B by the chucks 35 and then transferred to the second suction members 41 at the second transfer position B. However, since air will flow in between the two or more empty bags during the transportation by the chucks 35 and separate the bags. Accordingly, when the suction assistance plate 44 withdraws to the retreated position, empty bags other than the empty bag directly suctioned by the second suction members 41 will drop, and the multiple bag transfer is thus resolved.

Figure 5:
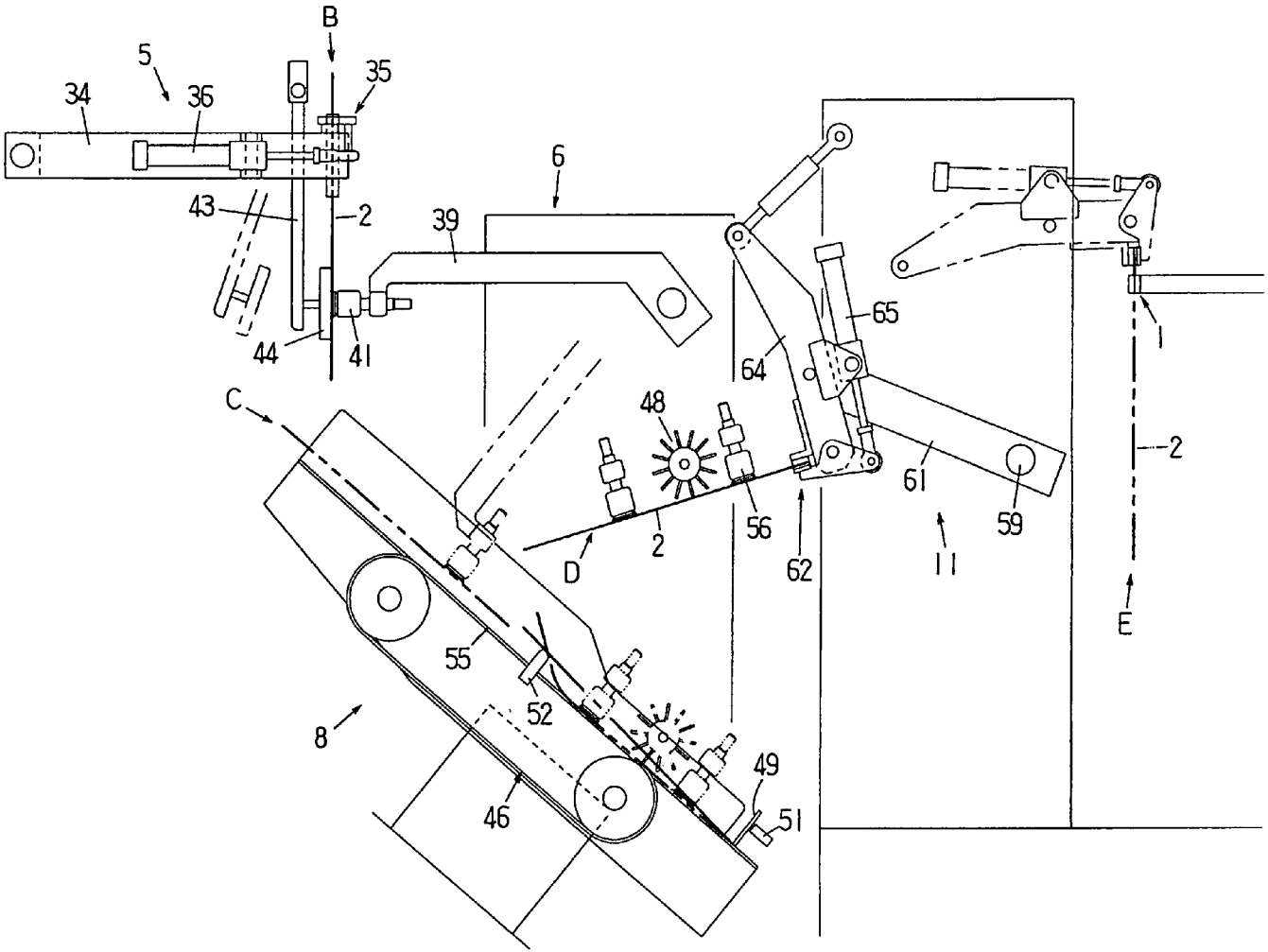
FIG. 5 is an enlarged side view primarily showing the right half of FIG. 1.
Figure 6:
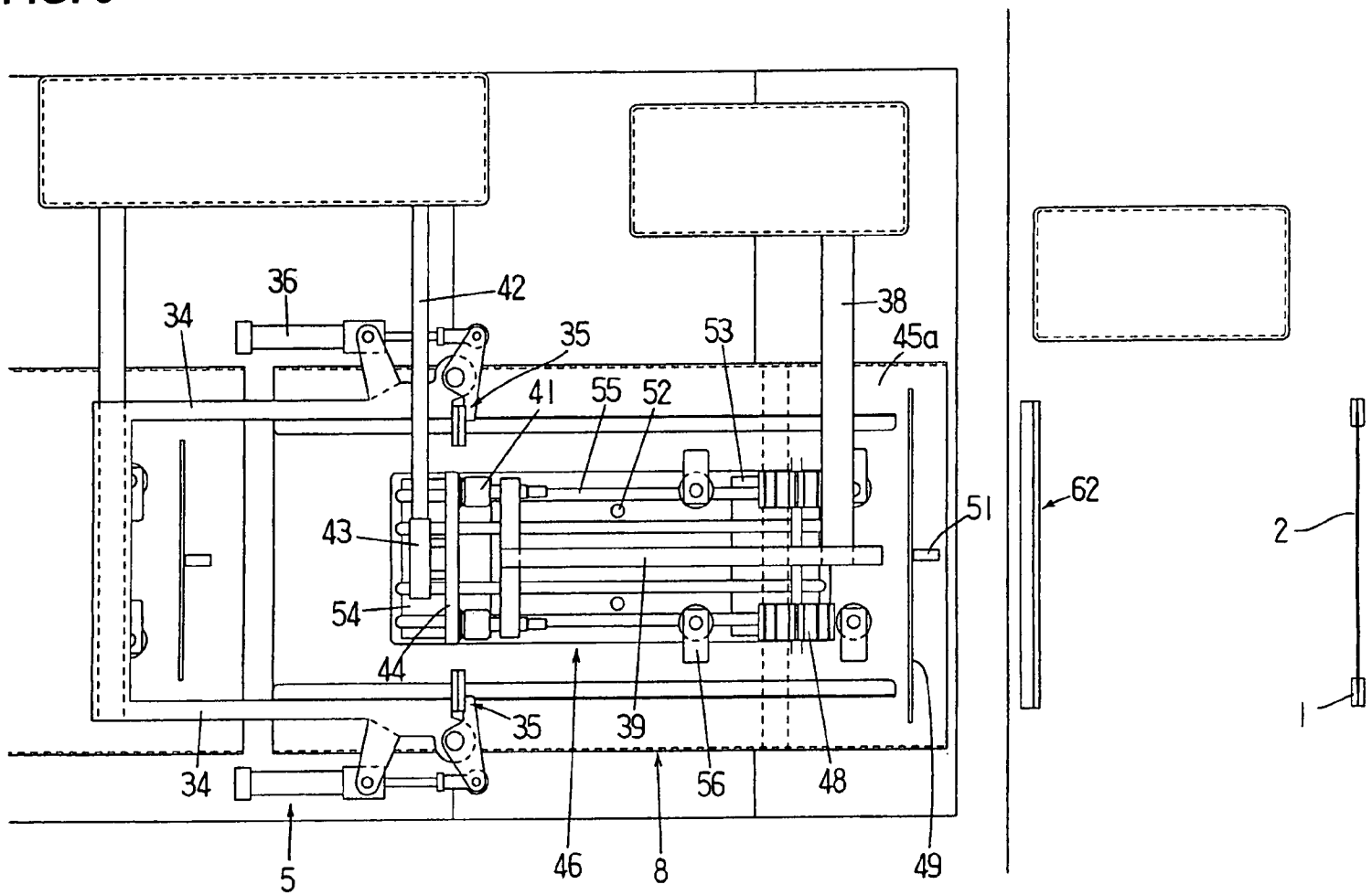
FIG. 6 is an enlarged top view primarily showing the right half of FIG. 2.

The positioning device 8 (called a "positioning conveyor" in the present invention) of the shown embodiment is provided under the second suction device 6 and is inclined as a whole downward to the front (see FIGS. 1 and 5). The positioning device 8 is comprised of a frame 45 installed on the base 12, a belt conveyor 46 installed in the center of the frame 45, and guide plates 47 installed on the left and right sides of the belt conveyor 46 on the top surface 45*a* of the frame 45. The positioning device 8 is further comprised of toothed wheels 48 disposed above the belt conveyor 46 at the front end of the belt conveyor 46, a second positioning stopper 49 affixed to the top surface 45*a* of the frame 45 so as to projecting out, a second sensor 51 for detecting whether the empty bag 2 on the belt conveyor 46 has contacted the second positioning stopper 49, and a pair of lifting members 52 that can project up through the conveyance surface of the belt conveyor 46 from below.

The belt conveyor 46 of the positioning device 8 includes pulleys 53 and 54 rotatably disposed on the frame 45 and four belts 55 provided around the pulleys 53 and 54. The pulley 53 is linked to a drive source (not shown) and rotated, thus rotatably drive the belts 55.

The toothed wheels 48 are the same as the toothed wheel 17 provided for the conveyor magazine 3. When bag-not-detected signal from the second sensor 51 continues for a predetermined length of time, the toothed wheels 48 are lowered and rotated and continue rotating until the second sensor 51 sends out a bag-detected signal. The rotation of the outside periphery of the toothed wheels 48 is faster than the rotation of the belt conveyor 46.

The lifting members 52 remain below the conveyance surface of the belt conveyor 46 until the second sensor 51 sends out a bag-detected signal, upon which the lifting members 52 are raised above the conveyance surface of the belt conveyor 46.

When the second suction members 41 of the second suction device 6 has transported the empty bag 2 to the lower third transfer position C and vacuum suction of the second suction members 41 is stopped, the empty bag 2 drops onto the belt conveyor 46 of the positioning device 8. At this point, the transfer of the empty bag 2 from the second suction members 41 to the positioning device 8 is completed. After the empty bag 2 has dropped onto the belt conveyor 46, the bag is moved forward by its own weight and by the belt conveyor 46. The empty bag 2 is further moved forward by the toothed wheels 48 and then comes into contact with the second positioning stopper 49 and is thus stopped, so that the empty bag 2 is positioned to lie on the underside on the conveyance surface of the belt conveyor 46. This positioning of the empty bag in the second suction device 6 is substantially the same as the positioning of the empty bag 2 in the conveyor magazine 3. However, the difference is that the part of the empty bag 2 that touches the second positioning stopper 49 is the tip end of the bag mouth whereas it is the bag bottom in the conveyor magazine 3, and the positioning by the second positioning stopper 49 is done with respect to the bag mouth.

When the empty bag 2 comes into contact with the second positioning stopper 49 and second sensor 51 emits a bag-detected signal, the lifting members 52 project upwards, raising the bottom end of the underside of the empty bag 2 as shown by the dotted line in FIG. 5, which allows a next empty bag to enter the space between the conveyance surface of belt conveyor 46 and the raised empty bag 2, so that the tip end of the bag mouth of the incoming next empty bag is in contact with the projected lifting members 52 and the next bag is thus stopped. This system increases the processing capacity of the positioning device 8.

The third suction device 9 of the shown embodiment is shown in the drawings by the four third suction members 56 only. The third suction members 56 are connected to switching valves and vacuum sources by vacuum piping (not shown), and they are provided so as to be able to ascend and descend (in the shown embodiment, they ascend and descend by swinging). The third suction members 56 suction the upper surface of the empty bag 2 that is in contact with and positioned by the second positioning stopper 49 and lift the bag to a fourth transfer position D (where the bag is transferred from the third suction members 56 to the second transporting member (chuck 62) to be described below) that is shown by the solid line in FIG. 5. When the second sensor 51 sends out a bag-detected signal, the third suction members 56 start vacuum suction, descend simultaneously, suction the spots near the bag mouth on the upper surface of the positioned empty bag 2 and then ascend to lift the bag mouth of the empty bag 2 so that the bag mouth side becomes somewhat higher than the bag bottom side. When the third suction members 56 ascend, the toothed wheels 48 also ascend simultaneously (see Japanese Patent Application Laid-Open (Kokai) No. 2003-137219).

The second transport device 11 of the shown embodiment is provided above and in a forward position (or on the downstream side in the bag transporting direction) of the third suction device 9. The second transport device 11 is comprised of a drive box 58 that is installed on the base 57 of a bag packaging apparatus (only the gripper 1 thereof is shown) and houses therein an internal drive mechanism; and the second transport device 11 is further comprised of a rotary shaft 59, which is connected to the drive box 58 so as to rotate within a predetermined range, and a swing arm 61, which is affixed to the rotary shaft 59 so as to swing within a predetermined range. In addition, the second transport device 11 is provided with a lever 64 and an air cylinder 65. The lever 64 is provided at one end thereof with a chuck 62 (called a "second transporting member" in the present invention), and the other end of the lever 64 is linked to the drive box 58 through a link 63. To the middle portion of the lever 64, the swing end of the swing arm 61 is rotatably connected. The air cylinder 65 is installed on the lever 64 so that it opens and closes the chuck 62. This type of second transport device 11 is disclosed in Japanese Patent Application Publication (Kokoku) No. 1995-5125 and thus is a known structure.

As the swing arm 61 swings, the lever 64 rotates, as seen from FIG. 5, widely between the position shown by the dotted line and the position shown by the solid line; and as the lever rotates, the chuck 62 receives the empty bag 2, which is suctioned by the third suction members 56 and arriving at the fourth transfer position D, from the third suction members 56, transports it to a higher fifth transfer position E (where the empty bag 2 is transferred from the second transporting member (chuck 62) to the gripper 1 of the bag packaging apparatus), and changes the attitude of the empty bag 2 to substantially vertical with the bag mouth facing upward. The transfer of the empty bag 2 from the third suction members 56 to the chuck 62 is completed after the chuck 62 holds the entire bag mouth of the empty bag 2 which has arrived at the fourth transfer position D and vacuum suction of the third suction members 56 is stopped.

The empty bag 2 arriving at the fifth transfer position E is gripped by the gripper 1 at its two edges near the bag mouth and then undergoes various packaging operations in the bag packaging apparatus.

In the above-described embodiment, the positioning device 8 is comprised of an inclined belt conveyor 46. The belt conveyor 46 and the top surface 45*a* of the frame 45 can be, however, horizontal instead of being inclined. A simple inclined chute (positioning chute), instead of the belt conveyor 46, can also be used as the positioning device. In this case, so as to allow the empty bag 2 to drop down by its own weight, the chute indeed needs to be inclined.

In addition, the positioning device 8 is provided with a pair of lifting members 52 that project up through the conveyance surface of the belt conveyor 46 from below. However, a different structure can be employed. For instance, a suctioning member that ascends and descends can be installed above the belt conveyor 46 so as to lift up the bag bottom side of a positioned empty bag 2, so that the empty bag 2 is suctioned and lifted up by the upper surface.

The invention claimed is:

1. An empty bag supply method that separates and feeds out an empty bag that is uppermost of a group of empty bags stacked on a conveyor in such a format that bag bottoms of the empty bags face forward and upper bags are shifted forward, feeds the empty bag forward so that the empty bag comes into contact with a first positioning stopper thus being positioned by a bag bottom thereof, then transports the empty bag along a predetermined bag transportation path, and then transfers the empty bag to a gripper of a bag packaging apparatus;

said empty bag supply method comprising the steps of:

changing an attitude of the empty bag being positioned by the bag bottom, so that the empty bag is brought substantially vertical with the bag bottom facing upward, transporting the empty bag with a bag mouth thereof facing forward and bringing the bag mouth into contact with a second positioning stopper, thus positioning the empty bag by the bag mouth, changing the attitude of the empty bag being positioned by the bag mouth, so that the empty bag takes a substantially vertical attitude with the bag mouth facing upward, and transferring the empty bag to said gripper of said bag packaging apparatus.

2. An empty bag supply method that separates and feeds out an empty bag that is uppermost of a group of empty bags stacked on a conveyor in such a format that bag bottoms of the empty bags face forward and upper bags are shifted forward, feeds the empty bag forward so that the empty bag comes into contact with a first positioning stopper thus being positioned by a bag bottom thereof, then transports the empty bag along a predetermined bag transportation path, and then transfers the empty bag to a gripper of a bag packaging apparatus;

said empty bag supply method comprising the steps of:

suctioning by a first suction member an upper surface of the empty bag being positioned by a bag bottom thereof, lifting up by said first suction member the empty bag to a first transfer position, holding by a first transporting member the empty bag moved to the first transfer position, transporting by said first transporting member the empty bag to a second transfer position and changing an attitude thereof so that the empty bag takes a substantially vertical attitude with the bag bottom facing upward, suctioning by a second suction member the empty bag, which is substantially in a vertical attitude, at a front surface thereof, transporting by said second suction member the empty bag, with a bag mouth thereof facing forward, to a third transfer position which is on a positioning means comprising one of a positioning conveyor and a positioning chute, bringing the bag mouth of the empty bag into contact with a second positioning stopper on said positioning means, thus positioning the empty bag by the bag mouth, suctioning by a third suction member the upper surface of the empty bag being positioned by the bag mouth, lifting up by said third suction member the empty bag to a fourth transfer position, holding by a second transporting member the empty bag moved to the fourth transfer position, transporting by said second transporting member the empty bag to a fifth transfer position and changing an attitude thereof so that the empty bag takes a substantially vertical attitude with the bag mouth facing upward, and transferring the empty bag to said gripper of said bag packaging apparatus.

3. An empty bag supply apparatus comprising a conveyor magazine provided with:

a belt conveyor for conveying a group of empty bags stacked in such a format that bag bottoms of the empty bags face forward and upper bags are shifted forward, a fast-feed belt for separating an uppermost empty bag from the group of empty bags on said belt conveyor and feeding out the empty bag forward, a toothed wheel provided on a forward side of said fast-feed belt on said belt conveyor so as to feed out the empty bag separated by said fast-feed belt forward, and a first positioning stopper with which a bottom end of the empty bag fed out by said toothed wheel comes into contact, whereby said empty bag supply apparatus transports the empty bag positioned by contacting said first positioning stopper along a predetermined bag transportation path and transfers the empty bag to a gripper of a bag packaging apparatus; and wherein said empty bag supply apparatus further comprises:

a first suction member that suctions an upper surface of the empty bag being positioned by said first positioning stopper and lifts up the empty bag to a first transfer position, a first transporting member that receives from said first suction member the empty bag moved to the first transfer position and transports the empty bag to a second transfer position so that the empty bag takes a substantially vertical attitude with a bag bottom thereof facing upward, a second suction member that suctions a front surface of the empty bag of substantially vertical attitude and transports the empty bag to a third transfer position with a bag mouth thereof facing forward, a positioning means that at the third transfer position receives the empty bag being suctioned by said second suction member and transports the empty bag forward, said positioning means being one of a positioning conveyor and a positioning chute and provided with a second positioning stopper with which a tip end of the bag mouth of the empty bag comes into contact, a third suction member that suctions the upper surface of the empty bag, which is in contact with said second positioning stopper and thereby being positioned, and lifts up the empty bag to a fourth transfer position, and a second transporting member that receives from said third suction member the empty bag moved to the fourth transfer position and transports the empty bag to a fifth transfer position so that the empty bag takes a substantially vertical attitude with the bag mouth facing upward, and wherein at the fifth transfer position said empty bag supply apparatus transfers the empty bag to said gripper of said bag packaging apparatus.

4. The empty bag supply apparatus according to claim 3, wherein said positioning means is provided with a lifting member that raises an underside of the empty bag which is in contact with said second positioning stopper by the bag mouth, thus creating a space between the empty bag and a supporting surface of said positioning means so that a next empty bag is allowed to enter the space.

5. The empty bag supply apparatus according to claim 3, wherein said positioning means is provided with a lifting member that projects up from below through a conveyance surface thereof so that said lifting member, when projected out above the conveyance surface, raises an underside of the empty bag which is in contact with said second positioning stopper by the bag mouth, thus creating a space between the empty bag and the conveyance surface so that a next empty bag is allowed to enter the space.

6. The empty bag supply apparatus according to any one of claims 3 through 5, wherein said empty bag supply apparatus further comprises a suction assistance plate which is provided near the second transfer position and moves back and forth between a retreated position that avoids interference with an empty bag being transported to the second transfer position and a suction assistance position that faces a suction surface of said second suction member which suctions the front surface of the empty bag being in a substantially vertical attitude at the second transfer position, and wherein said suction assistance plate supports a rear surface of the empty bag at the suction assistance position to assist said second suction member to suction the empty bag.

7. The empty bag supply apparatus according to any one of claims 3 through 5, wherein said first transporting member is comprised of a pair of gripping members that grip both side edges of the empty bag.

8. The empty bag supply apparatus according to any one of claims 3 through 5, wherein said first positioning stopper is positionally variable in a direction of conveyance of said belt conveyor.

* * * * *